United States Patent [19]

Takahashi et al.

[11] Patent Number: 5,018,202

[45] Date of Patent: May 21, 1991

[54] ELECTRONIC NOISE ATTENUATION SYSTEM

[75] Inventors: Minoru Takahashi, Tokyo; Tanetoshi Miura, 1-11-20 Minami-cho, Kokubunji, Tokyo; Hareo Hamada, 4-8-1 Kajino-cho, Koganei, Tokyo; Hideki Hyoudo, Yokohama; Ryusuke Gotoda, Tokyo; Yasushi Yoshimura, Tokyo; Takashi Kuribayashi, Tokyo; Akio Akasaka, Tokyo, all of Japan

[73] Assignees: Hitachi Plant Engineering & Construction Co., Ltd.; Tanetoshi Miura; Hareo Hamada

[21] Appl. No.: 313,475

[22] Filed: Feb. 22, 1989

[30] Foreign Application Priority Data

Sep. 5, 1988 [JP] Japan ..... 63-223028

[51] Int. Cl.[5] ..... G10K 11/16

[52] U.S. Cl. ..... 381/71

[58] Field of Search ..... 381/71, 94

[56] References Cited

U.S. PATENT DOCUMENTS 4,677,676 6/1987 Eriksson ..... 381/71

OTHER PUBLICATIONS

A Variable Step (VS) Adaptive Filter Algorithm, by Harris et al., IEEE Transactions on Acoustics, Speech, and Signal Processing, vol. ASSP-34, No. 2 (Apr. 1986).

Adaptive Signal Processing, by Widrow and Stearns, Chapter 11, pp. 270–301.

*Primary Examiner*—Forester W. Isen

*Attorney, Agent, or Firm*—Oliff & Berridge

[57] ABSTRACT

An electronic noise attenuation system for attenuating a sound wave propagated from a source of noise by generating another sound wave 180° out of phase and having the same sound pressure with the propagated sound wave from electro-mechanic transducer means disposed in a propagation passage of sound waves. In the electronic noise attenuation system, a drive signal for drive the electro-mechanic transducer means is generated in accordance with output signals respectively output from upstream-side and downstream-side mechano-electric transducer means respectively disposed in the propagation passage with the electro-mechanic transducer means therebetween. Namely, the drive signal is created by performing an operation on a difference signal between the output signal of the upstream mechano-electric transducer means and the drive signal according to a given transfer function. Also, the transfer function is determined in accordance with the difference signal and the output signal of the downstream mechano-electric transducer means.

4 Claims, 7 Drawing Sheets

ELECTRONIC NOISE ATTENUATION SYSTEM

BACKGROUND OF THE INVENTION

1. Field of the Invention

The present invention relates to a system for attenuating noise electronically and, in particular, to an electronic noise attenuation system which is capable of attenuating non-steady noise occurring in propagation passages such as duct lines or the like by exercising an adaptive control using a computer system including a digital filter therein.

2. Description of the Prior Art

Conventionally, there has been widely put into practical use a passive noise attenuation apparatus which attenuates noise occurring within ducts by use of the interference due to the duct structure or the noise absorption due to a porous material attached to the duct. However, this type of noise attenuation apparatus is found disadvantageous in that it is too big in size, it involves too much loss of pressure, and so on.

On the other hand, there is also available an active noise attenuation apparatus which has been long proposed and employs another method of the reduction of unwanted sounds within the duct. That is, recently, special interest has been given to an electronic noise attenuation system of such active type in which noise propagated from a source of noise is sensed, a cancellation sound having the same sound pressure and an opposite phase with respect to the sensed noise is generated against the noise to thereby provide sound wave interference between the noise and the cancellation sound, and thus the noise can be cancelled forcibly by the sound wave interference. With the rapid progress of an electronic device, signal processing technique and the like, there have been recently published various kinds of study results on such active electronic noise attenuation method and apparatus.

However, there are still left many problems to be solved and thus such electronic noise attenuation method or apparatus has not yet come into a stage of seriously practical application.

A technical problem in putting into practice such electronic noise attenuation system consists in the construction of a model which can be used as a basis for design of a control system of the electronic noise attenuation system. The model must be able to cope with the following points. At first, there is necessary a filter which is capable of cancelling noise of continuous spectra. That is, if a cancellation sound can be generated with respect to the noise of continuous spectra such as automotive noise, air current noise and the like as well as the noise of discrete spectra such as transformer noise, compressor noise and the like, the applications of the electronic noise attenuation system can then be expanded further. To realize this, a filter is required which is able to provide arbitrary amplitude characteristics and phase characteristics.

Secondly, it is necessary to prevent the feedback of the cancellation sound with respect to a sensing microphone. That is, in the electronic noise attenuation system, there is interposed the sensing microphone between a source of noise and a source of cancellation sounds within a propagation passage through which sound waves are propagated, and it is necessary to create an electric signal to drive the cancellation sound source which generates sound waves to cancel the propagated sound waves from the noise source, in accordance with the sounds sensed by the sensing microphone and by some proper signal generation means. In this case, the sound waves generated from the cancellation sound source is also caught by the sensing microphone and, as result of this, there is produced an acoustic feedback system between the cancellation sound source and the sensing microphone. For this reason, it is essential to take a countermeasure to cope with this situation. Especially in order to make compact the electronic noise attenuation system and to allow it to be mounted at an arbitrary position in a pipe line such as a duct line, the sensing microphone and the cancellation sound source must be located adjacent to each other. Therefore, the above-mentioned acoustic feedback has a great influence on the electronic noise attenuation system and thus the countermeasure to cope with this problem is very important.

Thirdly, it is necessary to make it possible to correct the characteristics of electro-acoustic transducers such as a microphone, speaker and the like used in the electronic noise attenuation system. That is, in order to stabilize the control function of the electronic noise attenuation system, it is essential that the control system of the electronic noise attenuation system is provided with a function to correct the minute amount of deterioration of the characteristics of the electro-acoustic transducers. This is another problem to be solved.

In view of this, we have already found and proposed models for an electronic noise attenuation system which can cope with the above-mentioned problems (Japanese Patent Application No.60-139293, No.60-139294, No.61-7115, No.62-148254.)

According to the electronic noise attenuation system that we have proposed, the above-mentioned third problem can be solved properly: that is, by properly controlling the characteristics of a digital filter for creating an electric signal to be given to a cancellation sound source, the system can cope with the variations of the propagation characteristics of a sound wave propagation passage (e.g., a duct) as well as the variations of the characteristics of a control system (which includes a speaker as a cancellation sound source, a microphone as a sensor and the like).

Referring now to FIG. 1, there is shown a basic structure of a monopole sound source type of adaptive electronic noise attenuation system including two sensor microphones M1, M2.

In this structure, the output of the sensor microphone M2, which is located on the down stream side of the figure, is as an error signal. The basic operation of the structure is to update the transfer function of a digital filter 2 from the input X of the digital filter 2 and the output E of the sensor microphone M2 so that the energy of the output E can be a minimum value under some evaluation standard or other.

Now, if an actual electronic noise attenuation system is modeled according to FIG. 1, then a model shown in FIG. 2 can be obtained. The model shown in FIG. 2 is constructed on the assumption that a sound wave to be fed back from a cancellation sound speaker (an additional sound source) S to the sensor microphone M1 is cancelled electrically at a point of addition 20 and thus it is not input to the digital filter 2.

What is important here is the existence of a transfer function D with a time delay representing the transfer characteristics of speaker, duct and the like from the output of the digital filter 2 to the addition point of the error signal.

By the way, in order to be able to apply a well-known adaptive control algorithm such as VS—LMS (Variable Step—Least Means Square) or the like, not only the input X of an adaptive digital filter must be defined clearly but also it is necessary to clarify the connection of the output Y of the digital filter with an error signal E. In the case of a system in which after the output of the digital filter 2 is determined the error signal E can be observed in an instant or a system in which the error signal E has already been decided at latest by the time of updating of the next coefficient of the digital filter, basically there arises no problem and thus the well-known algorithm can be applied. An echo canceller filter is a good example to deal with an acoustic signal and in this filter the output Y of the filter is reflected, as it is, in the error signal E. In contrast to this, in the electronic noise attenuation system shown in FIG. 1, the film output is not connected, as it is, with the error signal E but the error signal E can be obtained only by means of the electro-acoustic conversion characteristics of speaker, transfer characteristics from speaker to microphone, process of super-position (interference) of acoustic signals in space, and the acoustic-electric conversion characteristics of microphone. That is, if the above-mentioned transfer function D is not taken into consideration, then a sound cancellation effect cannot be obtained at all.

Further, in our previous application for patent (Japanese Patent Application No. 62-148254), as shown in FIG. 8, the restriction of an acoustic feedback is effective only when the transfer function from the speaker S to the microphone M1 is practically equal to that from the speaker S to the microphone M2. Most of linear duct equipment can satisfy this requirement.

However, when a sound cancelling device is constructed by mounting speaker to the bent portion of a duct, the above-mentioned structure is not able to perform its function to the full. For this reason, the present invention is proposed. Since the restriction of the acoustic feedback is performed by means of identification of the transfer function of a feedback system, the invention can be applied to any duct whatever shape it has. Also, the invention can apply even to an active sound cancellation system in a three-dimensional sound field (outdoor or indoor).

SUMMARY OF THE INVENTION

The present invention aims at eliminating the drawbacks found in the above-mentioned prior art systems.

Accordingly, it is an object of the invention to provide an electronic noise attenuation system which is capable of performing an adaptive control in consideration of the transfer function of a transmission system from a sound source for cancellation to a microphone for evaluation and is also capable of restriction of an acoustic feedback in an arbitrary duct shape.

In order to achieve the above object, according to the invention, there is provided an electronic noise attenuation system which achieves attenuation of a sound wave propagated from a source of noise in a propagation passage of a sound wave by generating another sound wave 180° out of phase and having the same sound pressure with the propagated sound wave to produce sound wave interference between the two sound waves at a given position in said propagation passage, said system comprising: first mechano-electric transducer means disposed at a position closer to the noise source from the above-mentioned given position in the propagation passage to sense the propagated sound wave from the noise source and convert it into an electric signal; electro-mechanical transducer means interposed between the position of the first mechano-electric transducer means and the given position in the propagation passage to generate a sound wave for cancelling the propagated sound wave from the source of noise at the given position; second mechano-electric transducer means interposed between the position of the electro-mechanical transducer means and the given position or disposed at the given position to sense the propagated sound waves from the electro-mechanical transducer means as well as from the source of noise and convert them into electric signals; operation means for inputting therein the output signal of the first mechano-electric transducer means and a drive signal to be given to the electro-mechanical transducer means to find a difference between them; drive signal generating means for inputting therein the output signal of the operation means to generate on the basis of a given transfer function a drive signal to be given to the electro-mechanical transducer means so that the amount of sound cancellation of the electronic noise attenuation system can be maximized; and, control means for determining a transfer function to be given to the drive signal generating means, setting up in the drive signal generating means a control parameter to specify the transfer function, and correcting the control parameter according to the variations of the propagation characteristics of the propagation passage as well as to the variations of the characteristics of the control system of the electronic noise attenuation system, characterized in that the control means outputs a pseudo-signal to the electro-mechanical transducer means to generate a sound wave in the sound wave propagation passage, specifies in accordance with the output signal of the second mechano-electric transducer means a transfer function with a time delay representing the transfer characteristics of a transfer system including a sound wave propagation passage ranging from the output terminal of the drive signal generating means to the second mechano-electric transducer means and an electric signal transmission path so that the output signal of the second mechano-electric transducer means can be minimized, and determines a transfer function to be given to the drive signal generating means in accordance with a given adaptive algorithm in consideration of the specified transfer function with a time delay.

In the electronic noise attenuation system according to the present invention, a sound wave based on an artificial signal is generated in a sound wave propagation passage from electro-mechanical transducer means which serves as a source of an additional sound, and, for this sound wave, a transfer function with a time delay representing the transfer characteristics of a transfer system, which includes a sound wave propagation passage ranging from the output terminal of drive signal generating means to second mechano-electrical transducer means and an electric sound transmission path, is specified by control means so that the output signal (error signal) of the second mechano-electric transducer means for evaluation of sound cancellation effects can be minimized.

In addition, the control means is able to determine a transfer function to be given to the above-mentioned drive signal generating means in accordance with a given adaptive algorithm in consideration of the transfer function with a time delay specified in the above-mentioned manner.

Thanks to the above-mentioned construction, an electronic noise attenuation system can be realized which enjoys a high effect on noise cancellation.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the preferred embodiment of an electronic noise attenuation system according to the present invention with reference to the accompanying drawings.

Figure 1:
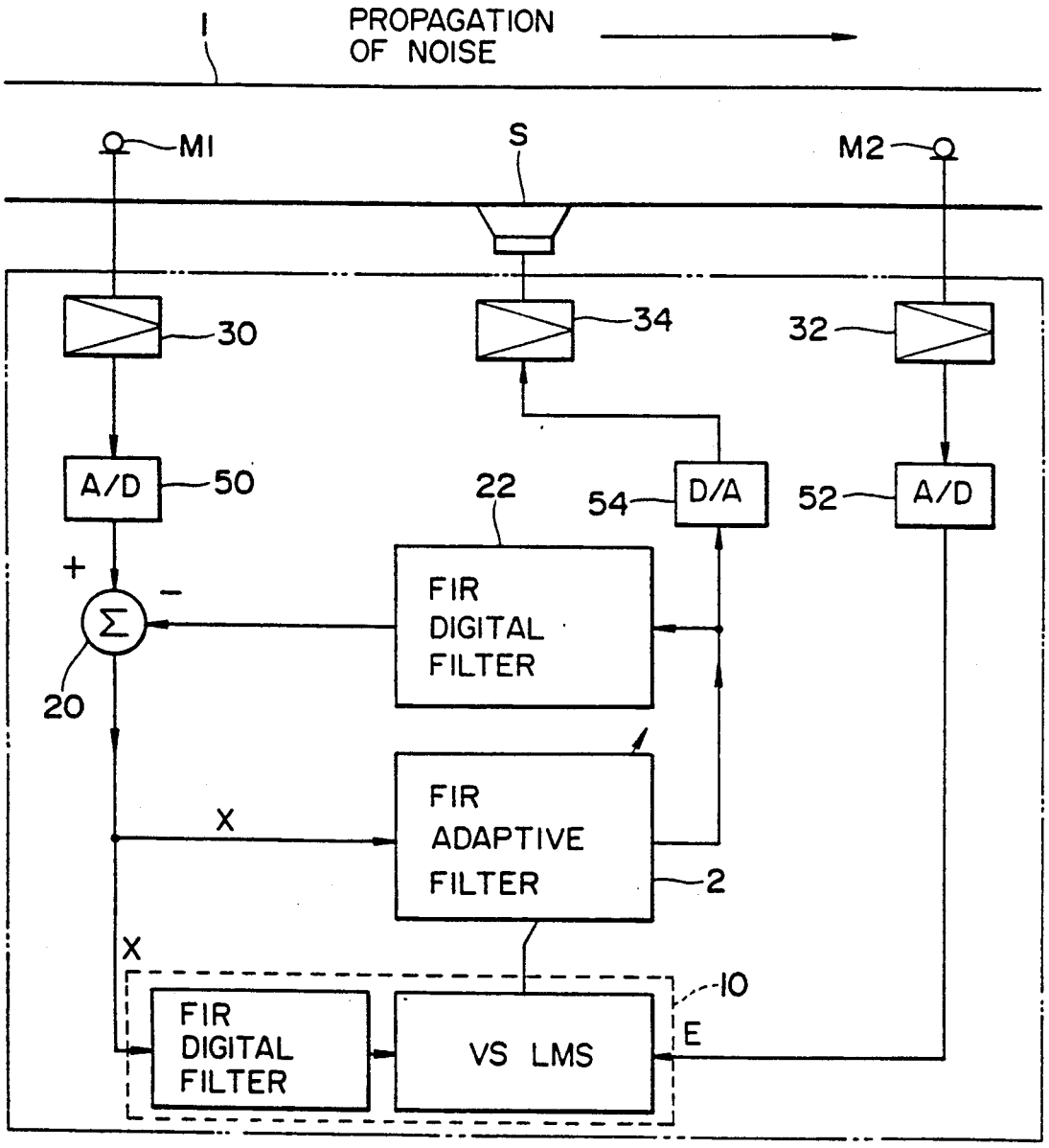
FIG. 1 is a view to show on principle the basic structure of an electronic noise attenuation system according to the present invention.

Referring now to FIG. 1, there is shown a basic structure of an electronic noise attenuation system according to the present invention. Although FIGS. 1 and 2 were already discussed simply for convenience' sake in the chapter of (Description of the Related Art), they will be described here again in detail because the above discussion is not sufficient for understanding of the present invention.

In FIG. 1, in a propagation passage 1 for sound waves, two sensor microphones M1, M2, which are respectively used to detect respectively sound waves propagated from a source of noise, are disposed on the upstream and downstream sides of a speaker S serving as a source of additional sounds with the speaker S as the reference position thereof. To a point of addition 20 are input the output signal of the sensor microphone M1 and the output signal of a digital filter 22 for restriction of acoustic feedback such that the output signal of the digital filter 22 is added to the output signal of the sensor microphone M1 while the former is opposite to the latter in phase.

Also, the output signal of the point of addition 20 is input to an adaptive digital filter 2 and a controller part 10. To the controller part 10 there is input the output of the sensor microphone M2 as an error signal E.

In the above-mentioned structure, the propagated sound waves from the source of noise are detected by the sensor microphones M1 and M2, and the output signal of the sensor microphone M2 is input to the controller part 10 as the error signal E.

At the point of addition 20 the outputs of the sensor microphone M1 and the digital filter 22 for restriction of acoustic feedback are added to each other in mutually opposing phases and the addition output thereof is input to the digital filter 2 and the controller part 10.

The controller part 10 performs such addition and output that the error signal E can be a minimum value. In other words, the controller part 10 is a device of an adaptive type which, in accordance with the input X of the digital filter and the error signal E, determines a transfer function to be given to the digital filter 2, and also supplies the digital filter 2 a filter coefficient which is a control parameter for specifying the thus determined transfer function. In the digital filter 2, the input signal X is processed or converted to a signal having given a given amplitude and phase characteristic in accordance with the filter coefficient given thereto. The output signal of the digital filter 2 is converted from digital to analog and is then output to the speaker S, namely the source of additional or cancelling sounds, which is adapted to generate cancelling sound waves for cancelling the propagated waves from the source of noise at the position of the sensor microphone M2. In this manner, the propagated sound waves from the source of noise can be cancelled at the position of the sensor microphone M2.

The above-mentioned cancelling sound waves from the speaker S can be detected or sensed by the sensor microphone M1 and, the detected components of the sensor microphone M1, that is, the sensed cancelling, sound waves can be cancelled by adding the output signal of the digital filter 22 representing the transfer characteristics from the sound cancelling digital filter 2 to the point of addition 20 with the phase thereof reversed, to the output signal of the sensor microphone M1 in the point of addition 20, so that the acoustic feedback from the speaker S to the sensor microphone M1 can be restricted. That is, the digital filter 22 acts as a digital filter for restricting the acoustic feedback.

Figure 2:
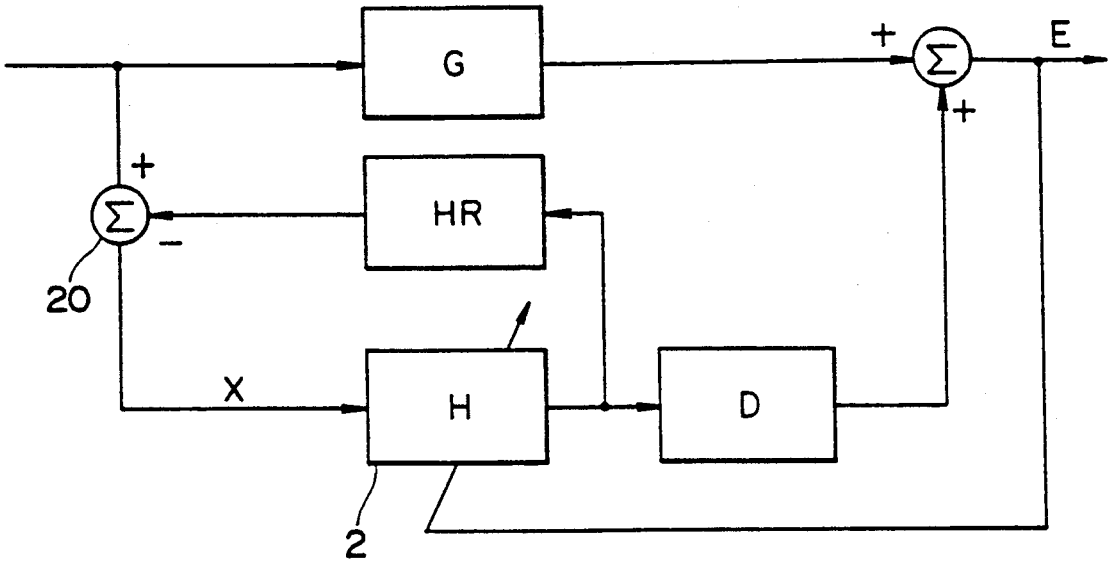
FIG. 2 is an explanatory view of a modeled version of the electronic noise attenuation system shown in FIG. 1.

In FIG. 2 which shows a modeled version of the electronic noise attenuation system shown in FIG. 1, reference character G designates a transfer function representing the propagation characteristics of sound waves within the propagation passage 1 between the sensor microphones M1 and M2 and the conversion characteristics of the sensor microphone M1 and M2. And, D, as described before, designates a transfer function representing transfer characteristics which include sound wave propagation characteristics of the propagation passages existing from the output terminal of the digital filter 2 to the point of addition for the error signal, that is, passages from the output terminal of the digital filter 2 to the speaker S and from the speaker S to the microphone M2 as well as the conversion characteristics of electro-acoustic transducers themselves such as the speaker S and the sensor microphone M2.

Figure 3:
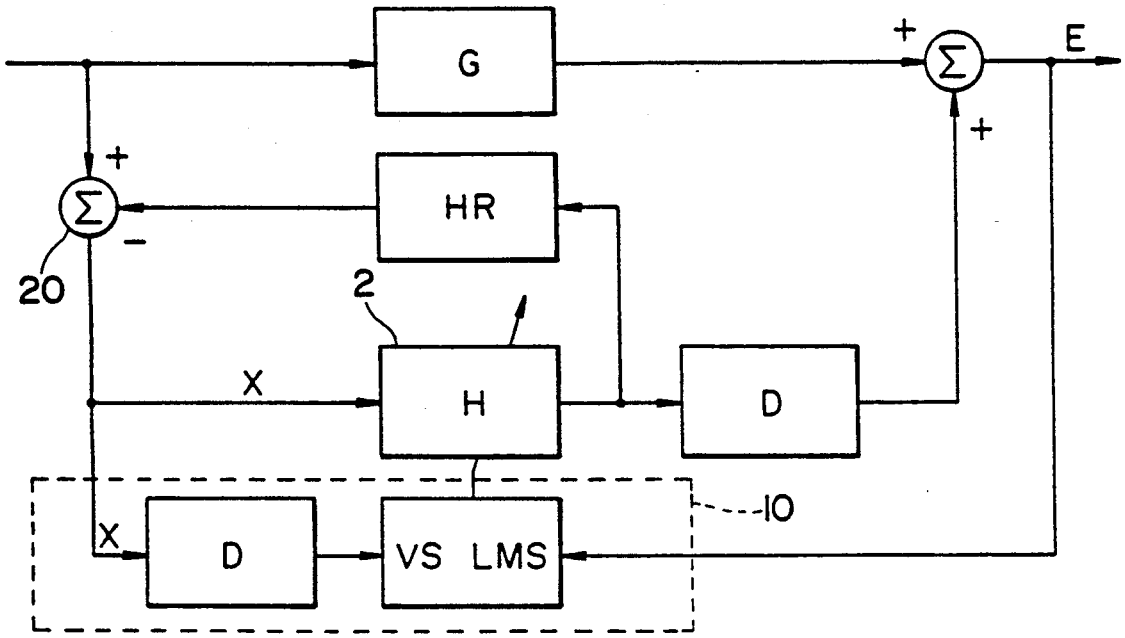
FIG. 3 is an explanatory view of an embodied model of the electronic noise attenuation system including a controller in consideration of a transfer function D with a time delay.

Next, in FIG. 3, there is shown a model obtained by embodying the electronic noise attenuation system including a controller in consideration of the above-mentioned transfer function D. In this model, the VS-LMS algorithm is employed in the controller part 10 as an adaptive control algorithm and the multiplication of the output signal X at the point of addition 20 by the transfer function D is considered as the input signal of the digital filter 2, whereby the coefficient of the digital filter 2 can be updated. Therefore, by replacing the input signal X by X·D as the input of the operation according to the VS-LMS algorithm, the updating of the filter coefficient according to the VS-LMS algorithm is possible.

The transfer function D, as will be discussed later, can be obtained by the controller part 10 prior to the operation of the system, thereby determining a filter coefficient which specifies the transfer function D. While the system is in operation, the filter coefficient is fixed and the digital filter 2 is controlled adaptively according to the VS-LMS algorithm.

Figure 4:
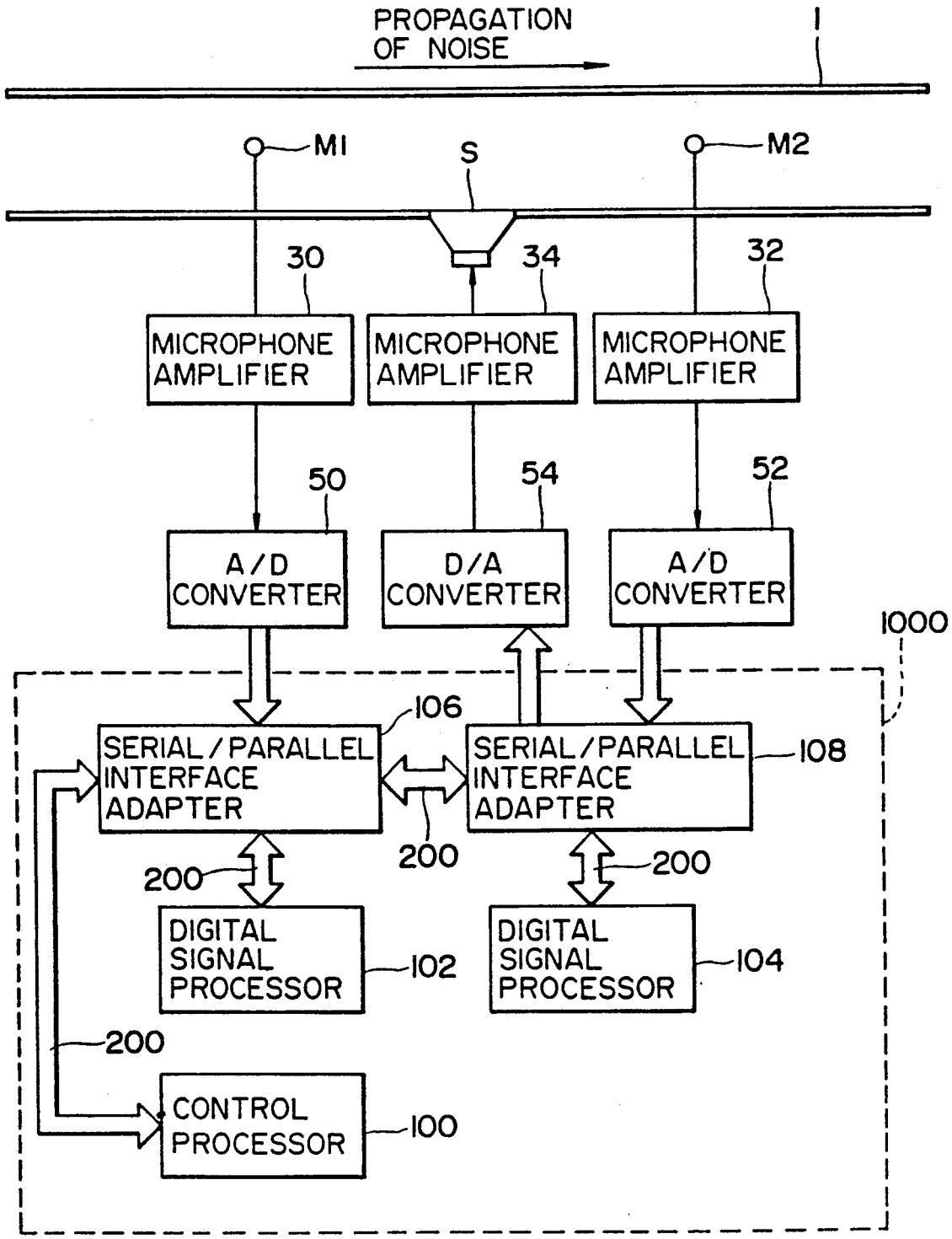
FIG. 4 is a block diagram of an embodied structure of the electronic noise attenuation system to which the model shown in FIG. 3 is applied.

Referring now to FIG. 4, there is shown the concrete structure of an electronic noise attenuation system to which the model shown in FIG. 3 is applied. In FIG. 4, within the propagation passage 1 there are provided the sensor microphones M1, M2 such that they are disposed with the speaker S, the source of cancellation sound, between them.

Numerals 30, 32 respectively designate microphone amplifiers for amplifying the output signals of the microphones M1, M2, respectively, and 34 stands for a power amplifier which amplifies a drive signal to be output to the speaker S up to a given level.

Also, 50, 52 respectively designate A/D converters, 54 a D/A converter, and 1000 a control part.

The control part 1000 comprises a control processor 100 for generally controlling the whole system, digital signal processors 102, 104 which respectively serve as a noise generator for measuring an adaptive digital filter to be discussed later, a digital filter of a fixed coefficient type and the above-mentioned transfer function D, and serial/parallel interface adapters 106, 108 converting a serial signal to a parallel signal or a parallel signal to a serial signal, all of which are connected to one another by means of bus lines 200.

Figure 5:
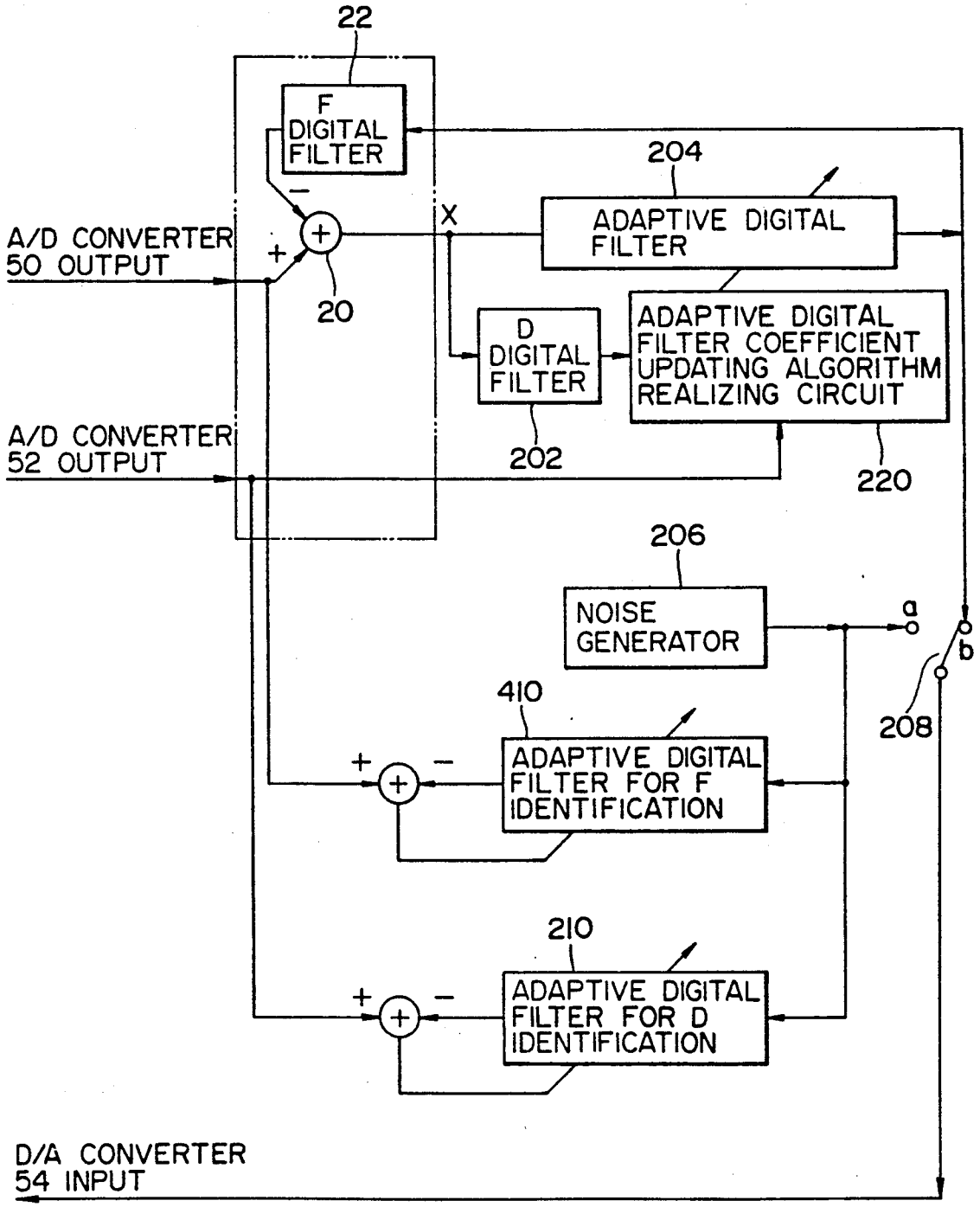
FIG. 5 is an explanatory view of a blocked embodiment of the operation of the control part of the electronic noise attenuation system shown in FIG. 1.

Now, description will be given of the operation of the electronic noise attenuation systems shown in FIG. 1 with reference to FIG. 5. FIG. 5 is a block diagram of the operation of the control part 1000. In FIG. 5, before the system is put into operation, a switch 208 is changed over to a point of contact and a pseudo-random noise is output from a noise generator 206 to the D/A converter 54.

On the other hand, the digital signal processor 104 is used to provide an adaptive digital filter 210. The adaptive digital filter 210 identifies the transfer function D of the digital filter 202 in accordance with an input signal (pseudorandom noise) from the noise generator 206 and the output signal (error signal) of the A/D converter 52 that is the output signal from the sensor microphone M2.

Also, similarly, in accordance with an input signal from the noise generator 206 and the output signal of the A/D converter 50 that is the output from the sensor microphone M1, an adaptive digital filter 410 identifies the transfer function F of the digital filter 22 for restriction of acoustic feedback.

Next, the switch 208 is changed over to a point of contact b to thereby make the electronic noise attenuation system ready for operation. Then, the filter coefficient representing the transfer function D identified by the digital filter 210 is set in the digital filter 202 and, similarly, the filter coefficient representing the transfer function F identified by the digital filter 410 is set in the digital filter 22. The digital filters 202 and 22 are shared by the digital signal processor 102 in the functions thereof, and the adaptive digital filter 204 and the adaptive digital filter coefficient updating algorithm realizing circuit 220 are shared by the digital signal processor 104 in the functions thereof. The adaptive digital filter 204 corresponds to the digital filter 2 in the model shown in FIG. 3.

In this state, to the point of addition 20 there are input electric signals respectively through the A/D converter 50 and digital filter 22 and, in the point of addition 20, the output signal of the A/D converter 50 and the inverted version of the output signal of the digital filter 22 are added together. In addition, in the digital filter 202, the output signal X of the point of addition 20 is multiplied by the transfer function D that is set in the digital filter 202.

The adaptive digital filter coefficient updating algorithm realizing circuit 220 takes therein the output signal of the A/D converter 52 as the error signal and, in accordance with this signal and the output X·D of the digital filter 202, updates the filter coefficient of the adaptive digital filter 204. The adaptive digital filter 204 performs a given operation on the output signal X of the point of addition 20 and, by means of the switch 208, outputs the resultant to the D/A converter 54 as the drive signal for the speaker S to cancel the propagated sound waves from the source of noise at the position where the sensor microphone M2 is set. The operation of the point of addition 20 in FIG. 5 is performed by the control processor 100 and, besides this, the control processor 100 transmits and receives signals to and from the electronic noise attenuation system and other systems (not shown) to which the electronic noise attenuation system is applied, such as air conditioning system and the like. Further, the control processor 100 monitors, the operation of the electronic noise attenuation system and, if anything wrong occurs in the system, performs processings to cope with it. In addition, the control processor 100 is able to check the noise cancelling digital filter 204 for its on/off operation on updating of the filter coefficient, so that the operation of the digital filter 204 can be controlled adaptively and thus the digital filter 204 is able to cope with unstable situations.

Although in the adaptive digital filters 204, 210, 410 shown in FIG. 2 there is used the VS—LMS algorithm, this is not limitative, but other adaptive algorithm such as the BLMS (Block Least Mean Square) or the FLMS (Fast Least Mean square) or the like may be employed. Also, in the above-mentioned embodiment the point of addition 20 is set at a position where the digital operation can be performed, but the point of addition 20 may be set, together with the digital filter 22, externally of the controller and the addition thereof may be executed at the stage of an analog signal.

Further, in the system construction shown in FIG. 4, there are used two digital signal processors and one control processor, but a microprocessor having a high function can be used in place of them to perform their functions. Moreover, the digital signal processors 102 and 104 can be replaced with high-speed multiplying-/adding devices, respectively.

Now, description will be given in more detail of the application of the invention by use of expressions in a block diagram according to FIG. 5. Here, the parts that are used in common with FIG. 5 are given the same designations and the description thereof is omitted here.

Figure 6:
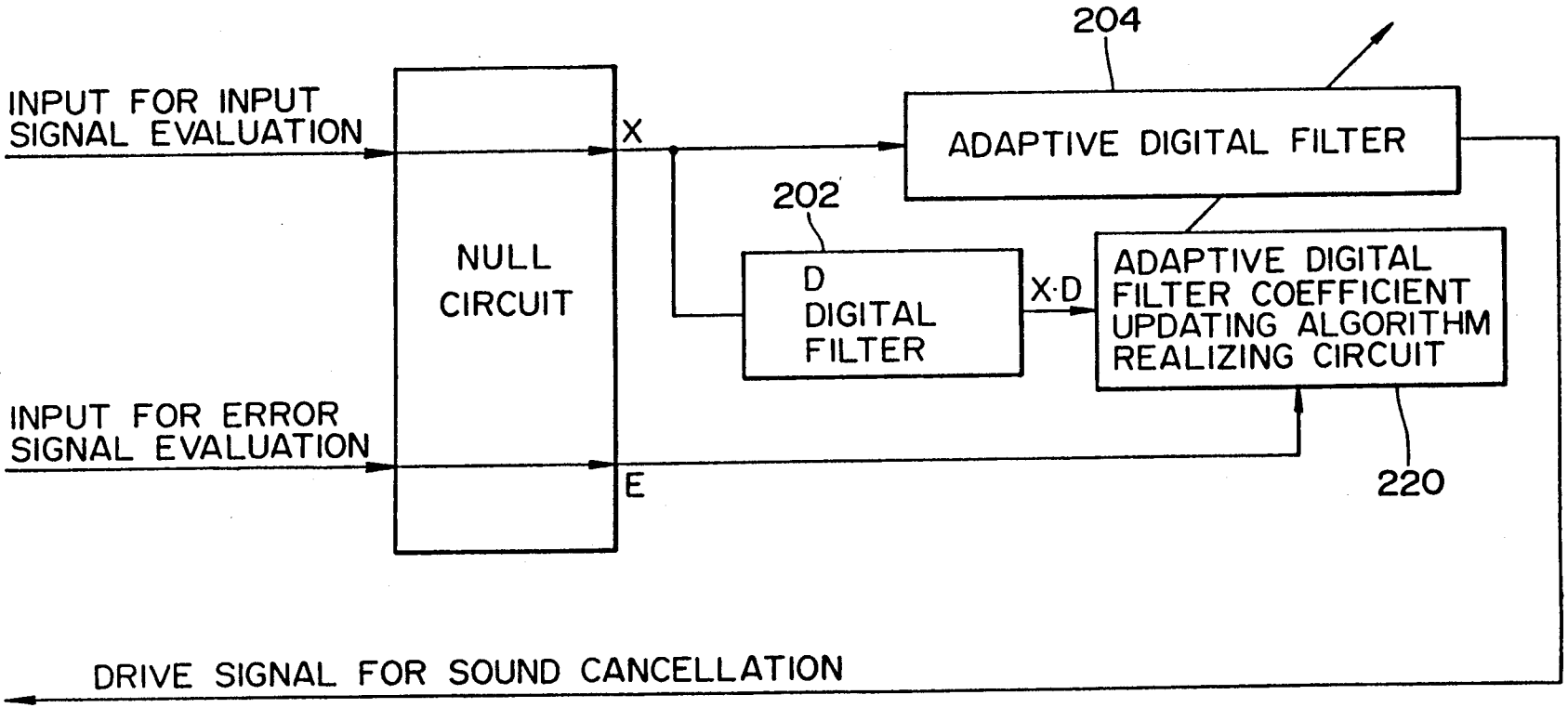
FIGS. 6 and 7 are respectively explanatory views of the modifications of the control part of the above-mentioned electronic noise attenuation system; and, FIG. 8 is a view of the structure of a conventional electronic noise attenuation system.

In a case when a special noise is to be cancelled, that is, in a case where electro-mechanical transducer means for generating an additional or cancelling sound is weakly connected to first mechano-electric transducer means for detecting a propagated signal from a source of noise to convert it into an electric signal, an acoustic feedback group need not be taken into consideration. For example, when the first mechano-electric transducer means such as a vibration pickup or the like is used to detect the vibration speed components of a source of noise not a sound pressure, or when, in structure, the first mechano-electric transducer means is weakly connected to the electro-mechanic transducer means for generating the additional sound because the former is disposed remotely from the latter, the input and error signals shown in FIG. 5 can be realized in a further more simplified construction. In the most simplifid case, as shown in FIG. 6, the noise detect signal can be directly used as the input signal of the adaptive digital filter 204. However, even in this case, due to the fact that there is essentially present the transfer function with a time delay between the electro-mechanic transducer means for generating the additional sound and the mechano-electric transducer means for detecting the error signal, it is necessary to secure a highly applicable adaptive digital filter system according to the invention as shown in FIG. 1, which provides an excellent noise cancelling effect.

Also, in FIG. 1, the digital filter 22 for restriction of acoustic feedback is formed of a digital filter of a fixed coefficient type, but, however, it is well known that a wider range of application can be provided if the digital filter 22 is composed of an adaptive digital filter.

Figure 7:
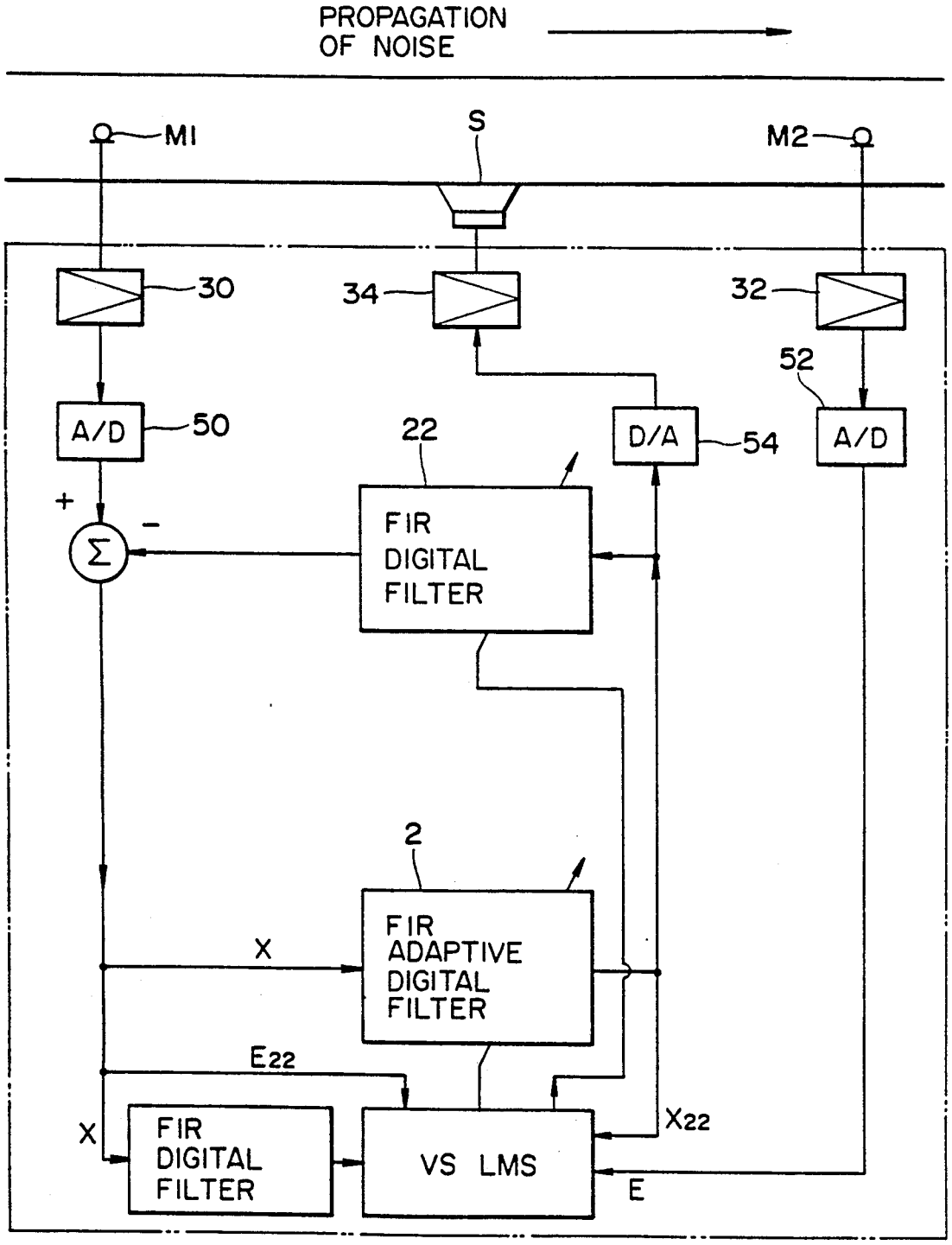
Figure 8:
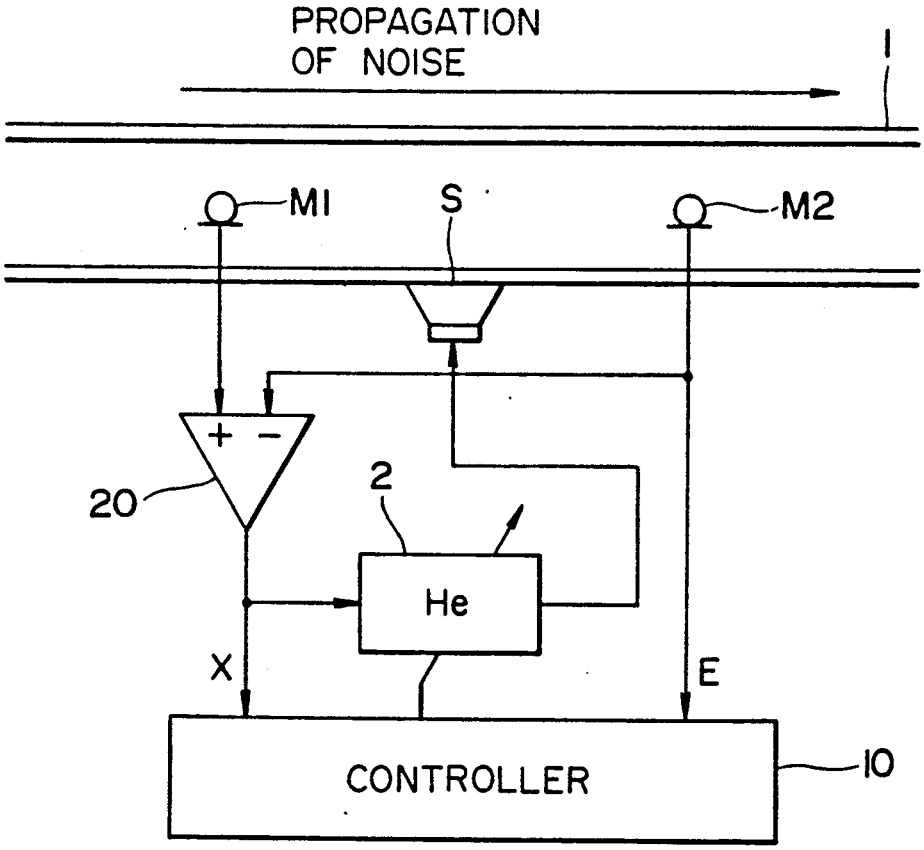

In FIG. 7, there is shown a concrete structure of the above-mentioned adaptive digital filter, in which E designates an error signal of the digital filter and X an input signal thereof. The adaptive digital filter may be used in combination with a digital filter 2 for adapter controlling/noise cancelling or may be used indepently.

As can be understood from the foregoing description, the present invention not only can apply to an electronic noise attenuation system but also can apply to all adaptive control systems including a transfer function with a time delay.

As has been described hereinbefore, in the electronic noise attenuation system according to the present invention, the electro-mechanic transducer means as the source of additional sound, prior to operation of the system, generates a sound wave in the propagation passage of sound waves according to a pseudo-signal, the control means, responsive to the sound wave generated by the electro-mechanic transducer means, specifies a transfer function with a time delay representing the propagation characteristics of propagation passages of sound waves existing from the output terminal of the drive signal generating means for generating a drive signal for the electro-mechanic transducer means to the second mechano-electric transducer means and the transfer characteristics of the transfer systems including the transfer paths of electric signals so that the output signal (error signal) of the second mechano-electric transducer means for evaluation of the noise cancelling effects of the generated sound wave can be a minimum value, and the control means, in consideration of the specified transfer function with a time delay, determines a transfer function to be given to the drive signal generating means in accordance with a given adaptive algorithm. Therefore, according to the invention, an electronic noise attenuation system which can enjoy a high noise cancelling effect can be realized.

It should be understood, however, that there is no intention to limit the invention to the specific forms, but on the contrary the invention is to cover all modifications, alternate constructions and equivalents falling with in the spirit and scope of the invention as expressed in the appended claims.

What is claimed is:

1. An electronic noise attenuation system for achieving attenuation of a sound wave propagated from a source of noise in a propagation passage of a sound wave by generating another sound wave 180° out of phase and having the same sound pressure with said propagated sound wave to produce interference between the two sound waves at a given position in said propagation passage, said system comprising:

first mechano-electric transducer means disposed at a position closer to said source of noise from said given position in said propagation passage to sense said propagated sound wave from said source of noise and convert it into an electric signal;

electro-mechanical transducer means interposed between the position of said first mechano-electric transducer means and said given position in said propagation passage to generate a sound wave for cancelling said propagated sound wave from said noise source at said given position;

second mechano-electric transducer means interposed between the position of said electro-mechanical transducer means and said given position or disposed at said given position to sense said propagated sound waves from said electro-mechanical transducer means and from said source of noise and convert them into electric signals;

an adaptive digital filter arranged to be given time varying filter coefficients so that an amount of noise attenuation can be the maximum, to perform the digital operation processing on output signals of said first mechano-electric transducer means in accordance with said time varying filter coefficients, and to create a drive signal to be applied to said electro-mechanical transducer means;

a digital filter arranged to be given filter coefficients indicating a transfer function between said electro-mechanical transducer means and said second mechano-electric transducer means, to perform the digital operation processing on output signals of said first mechano-electric transducer means in accordance with said filter coefficients; and control means for inputting therein output signals of said second mechano-electric transducer means and output signals of said digital filter, for calculating said time varying filter coefficients sequentially in accordance with a VS-LMS algorithm, and for updating said time varying filter coefficients of said adaptive digital filter by the thus calculated time varying filter coefficients.

2. An electronic noise attenuation system as set forth in claim 1, wherein said control means comprises a noise generator for generating a pseudo-signal, change-over means for inputting therein said drive signal and pseudo-signal and outputting either of said input signals to said electro-mechanical transducer means, and an identifying adaptive digital filter for identifying said filter coefficients and also wherein said control means switches said change-over means when said system is initiated to output said pseudo-signal to said electro-mechanical transducer means, identifies filter coefficients of said identifying adaptive digital filter so that a signal obtained by means of digital operation processing on said pseudo-signal by said identifying adaptive digital filter can be identical with the output signal of second mechano-electric transducer means, and sets the thus identified filter coefficients as said filter coefficients of said digital filter.

3. An electronic noise attenuation system for achieving attenuation of a sound wave propagated from a source of noise in a propagation passage of a sound wave by generating another sound wave 180° out of phase and having the same sound pressure with said propagated sound wave to produce interference between the two sound waves at a given position in said propagation passage, said system comprising:

first mechano-electric transducer means disposed at a position closer to said source of noise from said given position in said propagation passage to sense said propagated sound wave from said source of noise and convert it into an electric signal;

electro-mechanical transducer means interposed between the position of said first mechano-electric transducer means and said given position in said propagation passage to generate a sound wave for cancelling said propagated sound wave from said noise source at said given position;

second mechano-electric transducer means interposed between the position of said electro-mechanical transducer means and said given position or disposed at said given position to sense said propagated sound waves from said electro-mechanical transducer means and from said source of noise and convert them into electric signals;

a first digital filter arranged to be given first filter coefficients representing a transfer function between said electro-mechanical transducer means and said first mechano-electric transducer means and to perform the digital operation processing on drive signals to be applied to said electro-mechanical transducer means in accordance with said first filter coefficients;

operation means for finding a difference between the output signal of said first mechano-electric transducer means and the output signal of said first digital filter;

an adaptive digital filter arranged to be given time varying filter coefficients so that an amount of noise attenuation can be the maximum, to perform the digital operation processing on output signals of said operation means in accordance with said time varying filter coefficients, and to create said drive signal to be applied to said electro-mechanical transducer means;

a second digital filter arranged to be given second filter coefficients representing a transfer function between said electro-mechanical transducer means and said second mechano-electric transducer means, and to perform the digital operation processing on output signals of said operation means in accordance with said second filter coefficients; and control means for inputting therein output signals of said second mechano-electric transducer means and output signals of said second digital filter, for calculating said time varying filter coefficients sequentially in accordance with a VS−31 LMS algorithm, and for updating said time varying filter coefficients of said adaptive digital filter by the thus calculated time varying filter coefficients.

4. An electronic noise attenuation system as set forth in claim 3, wherein said control means comprises a noise generator for generating a pseudo-signal, change-over means for inputting therein said drive signal or pseudo-signal and outputting either of said signals to said electro-mechanical transducer means, a first adaptive digital filter for identifying said first filter coefficients, and a second adaptive digital filter for identifying said second filter coefficients, and also wherein said control means switches said change-over means when said system is initiated to output said pseudo-signal to said electro-mechanical transducer means, identifies filter coefficients of said first adaptive digital filter so that a signal obtained by means of digital operation processing on said pseudo-signal by said first adaptive digital filter can be identical with the output signal of said first mechano-electric transducer means, sets the thus identified filter coefficients as said first filter coefficients of said first digital filter, identifies filter coefficients of said second adaptive digital filter so that a signal obtained by means of digital operation processing on said pseudo-signal by said second adaptive digital filter can be identical with the output of said second mechano-electric transducer means, and sets the thus identified filter coefficients as said second filter coefficients of said second digital filter.

* * * * *